United States Patent [19]

Flatau

[11] 4,337,911

[45] Jul. 6, 1982

[54] NON-SPINNING PROJECTILE

[76] Inventor: Abraham Flatau, 2004 Stockton Rd., Joppa, Harford County, Md. 21085

[21] Appl. No.: 132,721

[22] Filed: Mar. 24, 1980

[51] Int. Cl.[3] ..... F42B 13/00

[52] U.S. Cl. ..... 244/3.1; 102/501

[58] Field of Search ..... 244/3.1, 3.24; 102/436, 102/501

[56] References Cited

U.S. PATENT DOCUMENTS

| | | | |
|---|---|---|---|
| 879,079 | 2/1908 | Bon | 244/3.1 |
| 3,132,587 | 5/1964 | Fuller | 244/3.1 |
| 3,468,501 | 9/1969 | Baum | 244/3.1 |
| 3,873,048 | 3/1975 | Platou | 244/3.1 |

*Primary Examiner*—Charles T. Jordan

*Attorney, Agent, or Firm*—Nathan Edelberg; Robert P. Gibson; Harold H. Card, Jr.

[57] ABSTRACT

A non-spinning projectile for combat use against battlefield targets has a tapered paramidal shape with a sharply pointed nose. At supersonic launch speeds the nose causes formation of a generally conical shock wave. Along its length aft of its nose, the projectile has two fin-like projections spaced apart on each side of a symmetrical undersurface and adapted to capture the shock wave so that its pressure effects provide lifting force to the projectile undersurface.

1 Claim, 12 Drawing Figures

NON-SPINNING PROJECTILE

GOVERNMENT INTEREST

The invention described herein may be manufactured, used and licensed by or for the government for governmental purposes without the payment to me of any royalties thereon.

BACKGROUND OF THE INVENTION

The present invention relates to non-spinning projectiles and in particular to a projectile having a tapered body and an underside shaped to produce shock waves that produce compression lift.

The supersonic and hypersonic aerodynamics of vehicles having on their underside a pair of outwardly extending surfaces and edges, have been previously studied. Such a known vehicle produces a shock wave upon which the vehicle rides. This phenomenon, sometimes referred to as a "wave-rider" phenomenon, has been considered by the prior art.

Known projectiles generally employ an axially symmetric shape. This shape produces a shock wave which bears symmetrically around the perimeter of the projectile. Consequently, the shock wave does not produce any net force or lift. Therefore, the trajectory of such an axially symmetrical projectile is ballistic and the projectile's maximum range is thus limited to what may be determined by the conventional mathematics of ballistics.

SUMMARY OF THE INVENTION

In accordance with the illustrative embodiments demonstrating features and advantages of the present invention, there is provided a non-spinning projectile for launching at a predetermined velocity at a given target. This projectile comprises a tapered body including a terminal ballistic capability. The tapered body has a pair of outward longitudinal extensions having a surface formed into a leading edge. Upon launch at the predetermined velocity these surfaces and edges produce shock waves. These shock waves bear upon the underside of the body to generate compression lift. The above mentioned terminal ballistic capability is such as to inflict destructive force upon the target upon delivery of the body at the target.

Since this projectile employs lift it has a relatively flat trajectory that can be advantageous for short and long range missions. For long range missions the projectile need not ascend to heights where unpredictable meterological conditions could degrade accuracy. For short range missions, the projectile can travel without significant deviation from the initial line of sight, thereby facilitating aiming. Various shapes are anticipated including a pyramidal shape wherein the base is a concavo-convex polygon. The center underside portion of the body having the outward extensions may extend the entire length of the body or just a portion thereof. In addition, the underside may be shaped as a diverging trough which has two or more faces, or which is curved.

The projectile may be formed of a relatively dense material such as tungsten alloy. This relatively dense, massive core of material enables the projectile to destroy a target upon impact by virtue of the extremely high kinetic energy associated with the projectile. Alternatively, the projectile may carry a high explosive payload which detonates in the vicinity of or upon impact with the target. It is anticipated that for some embodiments, especially long range projectiles, that the projectile may include a guidance control system. Such a system may take the form of a homing device in the projectile nose which cooperates with course correction thrusters in the tail of the projectile. In addition, this guidance control system can include gyroscopic gear to keep the projectile stable in roll and pitch. It is also anticipated that the above projectile may be conveniently launched from aircraft which operate at relatively high mach number.

Therefore projectiles according to the present invention can provide a long range weapon that has a relatively flat trajectory due to the lift generated.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF THE PREFERRED EMBODIMENTS

Figure 1:
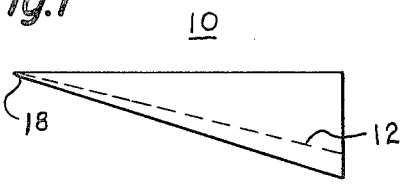
FIG. 1 is a side view of a projectile in accordance with the present invention.
Figure 2:
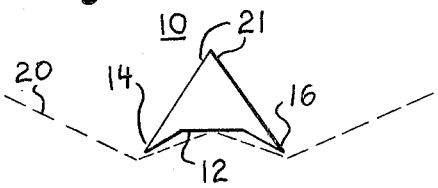
FIG. 2 is a rear view of the projectile of FIG. 1.

Referring to FIG. 1 there is shown a non-spinning projectile comprising tapered body 10. Body 10 has a generally pyramidal shape although curved or frustroconical shapes are possible. The underside of body 10 has a central underside portion 12 which is shown in phantom herein. Referring to the rear view of FIG. 2, the underside is shown composed of a pair of longitudinal extensions 14 and 16 whose inside surfaces form side walls. It will be observed from FIGS. 1 and 2 that the tapered body 10 has a pyramidal shape. In particular, the base as shown in FIG. 2 is polygonal and has on each of its edges a triangular face (FIG. 1) projecting from it and merging at the forward vertex 18 (FIG. 1). Accordingly, underside 12 comprises three contiguous, triangular, planar walls. The cross-section of body 10, as most clearly illustrated in FIG. 2, is concavo-convex in that the upper surface 21 arches outward while the lower surface 12 arches inwardly. Upper surface 21 comprises two contiguous, triangular, planar surfaces.

Body 10 includes a terminal ballistic means in that it is comprised of a relatively dense tungsten alloy. As such it may operate as a kinetic energy penetrator, destroying the target upon impact by virtue of the massive kinetic energy associated with such a rapidly moving projectile. It is to be understood, however, that other terminal ballistic means are contemplated. For example, the body 10 may be hollow and filled with a high explosive that detonates upon impact with or in the vicinity of a target. The composition of such an explosive and the equipment for detonating it are so well known that further elaboration is unnecessary.

Referring to FIG. 2, the dotted line 20 illustrates a shock wave produced by the edges 14 and 16 when the projectile body 10 is traveling at supersonic velocity. It is to be observed that the inboard portion of this shock wave bears upon the underside of body 10 and in this fashion creates lift. Accordingly, the body does not tend to fall in the way it otherwise might if lift were not being generated.

Figure 3:
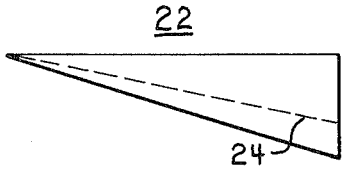
FIG. 3 is a side view of a projectile according to the present invention that is an alternate to that of FIG. 1.
Figure 4:
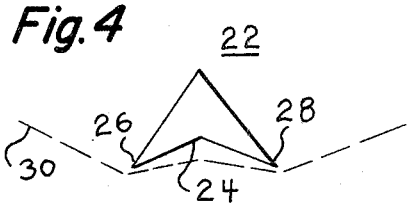
FIG. 4 is a rear view of the projectile of FIG. 3.

Referring to FIGS. 3 and 4, a side and rear view, respectively, of an alternate projectile is given. The projectile body 22 again has an underside 24 which is formed from a pair of longitudinally extended surfaces and edges 26 and 28. The shape is again essentially pyramidal and the cross-section is also concavo-convex. The essential difference here is that underside 24 is formed of two contiguous, planar walls instead of three as in the previously described embodiment. It will be observed by reference to FIG. 4 that a shock wave, similar to the previously described shock wave, is generated and is illustrated herein by dotted line 30.

Figure 5:
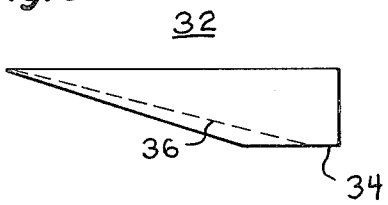
FIG. 5 is a side view of a projectile according to the present invention that is an alternate to that of FIG. 1.
Figure 6:
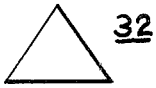
FIG. 6 is a rear view of the projectile of FIG. 5.
Figure 7:
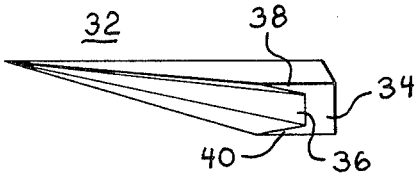
FIG. 7 is a bottom perspective view of the projectile of FIG. 5.

Referring to FIGS. 5 and 6 there is shown a side and rear view, respectively, of a third alternate embodiment according to the present invention. The projectile body 32 is similar to that previously illustrated in FIG. 1, except that this projectile is essentially truncated along horizontal surface 34. Accordingly, the underside 36 extends only along part of the length of body 32. The cross-section of body 32 at a mid-point would be similar to the concavo-convex view previously given in FIG. 2. However, the rear view as illustrated in FIG. 6 is triangular since the underside 36 fails to reach the rear of body 32. The shock wave produced upon launch of body 32 will, however, be similar to that illustrated in connection with FIG. 2. As shown in the bottom perspective view of projectile 32 in FIG. 7, underside 36 is formed from two longitudinally extended surfaces and edges 38 and 40. Underside 36 is formed of three contiguous walls, the two opposite walls being the inner surfaces 38 and 40.

Figure 8:
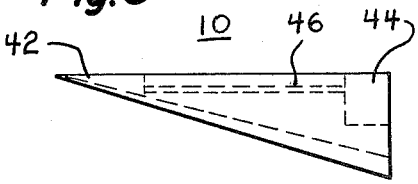
FIG. 8 is a side view of the projectile of FIG. 1, but modified to include a guidance system.

Referring to FIG. 8, the projectile of FIG. 1 is shown modified to include a forward chamber 42 and an aft chamber 44 which house a guidance means. These chambers are formed in nose and tail sections which are removable. Accordingly, the basic projectile can be fitted with various guidance and control systems as well as various arming and triggering devices. In the embodiment of FIG. 8, the nose section 42 includes a homing device such as a heat seeking sensor. The equipment of nose section 42 is coupled by means of conduit 46 to aft chamber 44. Aft chamber 44 includes various apparatus to stabilize and control the flight characteristics of body 10. It is anticipated that gyroscopic stabilizers, attitude thrusters, supporting electronics, etc. will be installed in chamber 44 to correct the course and stabilize the pitch and roll of projectile body 10. It is to be appreciated that other known guidance systems may be employed herein. Also in this embodiment the space between chambers 42 and 44 is a cavity filled with a high explosive material which is detonated by a trigger device in forward chamber 42.

To facilitate an understanding of the principles associated with the foregoing equipment, the operation of the projectile of FIG. 1 will be briefly described. It is to be understood that the operation of the various other embodiments is similar and need not be specifically described. Moreover, the embodiments including guidance and control systems need not be specifically described since the equipment and manner of operation of such systems is conventional and known in the art.

Figure 11:
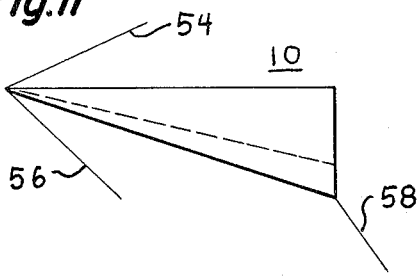
FIG. 11 is a side view of the projectile of FIG. 1 showing its shock waves.
Figure 12:
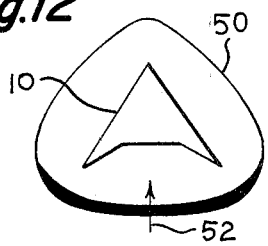
FIG. 12 is a rear view of the projectile of FIG. 2 showing the distribution and intensity of pressure around the body.

The projectile of FIG. 1 may be fitted into a well known sabot (not shown) and fired in the conventional manner from a gun or cannon. Alternatively, the projectile may be launched from an aircraft traveling at a high mach number to provide a stand-off capability. Upon launch at supersonic velocity, the projectile produces a shock wave which is depicted by the dotted line in FIG. 2. It is to be observed that the inboard portion of this shock wave bears upon the underside of the projectile. Referring to FIG. 12, the distribution of pressure surrounding body 10 and its relative intensity is illustrated by 50. It will be observed that the pressure surface 50 is not circular and is unbalanced. That is, higher upward pressure at the bottom and lower pressure around the sides and upper area. As a result there is a net upward force or lift that is illustrated by arrow 52. The position of the shock wave as viewed from the side is also illustrated in FIG. 11. It should be noted that the upper shock wave 54 is of lesser intensity than the lower shock wave 56. The shock wave emanating from the tail of projectile 10 is illustrated by shock wave line 58. The net effect of the various shock waves and pressure effects is that the projectile body 10 rides on its own shock wave. This effect enables the projectile to traverse a relatively flat trajectory. Accordingly, the aiming of the projectile is simplified since excessive correction need not be made for the normal ballistic trajectory particularly in the situation where the projectile is being fired over relatively short distances. This feature enables the projectile to be fired in a directly aimed manner.

Upon reaching the target (not shown) the projectile, since it is formed of a relatively massive tungsten alloy, strikes and imparts a destructive impulse to the target.

Figure 9:
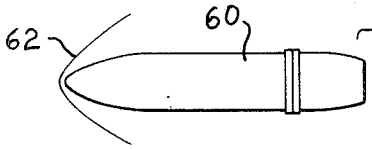
FIG. 9 is a side view of a projectile according to the prior art.
Figure 10:
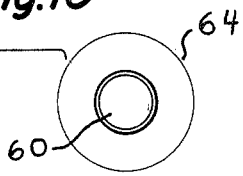
PRIOR ART Fig.10
FIG. 10 is a front view of the projectile of FIG. 9.

The shock wave and flight characteristics of the foregoing projectile ought to be compared to the shock wave produced by projectiles of the prior art. Projectile 60 of FIG. 9 is essentially axially symmetric. Accordingly its shock wave 62 is also axially symmetric. When viewed from the front as in FIG. 10 the pressure distribution around the projectile is symmetrical circle 64. Accordingly, the prior art projectiles exhibit no lift capability and follow a conventional ballistic trajectory.

Therefore, non-spinning tapered projectiles according to the present invention generate lift and thus have a unique trajectory that is relatively flat. Accordingly, the present projectile can be readily adapted to various weapon systems such as anti-armor, long range artillery, air to ground, etc.

It is to be appreciated that various modifications may be implemented with respect to the above described preferred embodiments. For example, while planar surfaces are illustrated herein it is anticipated that for some embodiments, the surfaces may be relatively smooth and that the cross-section of the projectile will have a smooth crescent-like shape. Furthermore, various dimensions, angles, and materials can be varied to produce the desired trajectory, flight stability, weight, ballistic coefficient etc. Also as previously mentioned, the projectile may or may not include flight guidance control equipment depending upon the intended range and mission of the projectile. Also as previously mentioned, the terminal ballistic capability of the projectile may be a relatively dense medium (kinetic energy penetrator) or a high explosive.

Obviously many other modifications and variations of the present invention are possible in light of the above teachings. It is therefore to be understood that within the scope of the appended claims, the invention may be practiced otherwise than as specifically described.

What is claimed is:

1. A non-spinning projectile for launching at a predetermined velocity at a given target comprising:

a tapered body having a pair of outward longitudinal extensions on the underside of said body, said extensions having a surface formed into a leading edge for producing upon launch at said predetermined velocity a shock wave which causes pressure upon said underside of said body to generate lift, said body, including terminal ballistic means for inflicting destructive force upon said target upon delivery of said body at said target, said tapered body having a generally pyramidal shape with a transverse cross-section that is concavo-convex, and said underside of said body comprises three, contiguous, triangular, planar walls.

* * * * *